US007565950B2

(12) United States Patent
Hawkins et al.

(10) Patent No.: US 7,565,950 B2
(45) Date of Patent: Jul. 28, 2009

(54) SOUND SUPPRESSION MATERIAL AND METHOD

(75) Inventors: Gary F. Hawkins, Torrance, CA (US); Michael J. O'Brien, Los Angeles, CA (US)

(73) Assignee: The Aerospace Corporation, El Segundo, CA (US)

( * ) Notice: Subject to any disclaimer, the term of this patent is extended or adjusted under 35 U.S.C. 154(b) by 428 days.

(21) Appl. No.: 11/043,198

(22) Filed: Jan. 26, 2005

(65) Prior Publication Data

US 2006/0162998 A1 Jul. 27, 2006

(51) Int. Cl.
*F01N 1/06* (2006.01)

(52) U.S. Cl. ..... 181/207; 181/208; 181/209; 181/286; 181/290

(58) Field of Classification Search ..... 181/206, 181/207, 208, 209, 214, 284, 286, 290, 292, 181/293, 288, 291
See application file for complete search history.

(56) References Cited

U.S. PATENT DOCUMENTS

| | | | | |
|---|---|---|---|---|
| 2,177,393 | A * | 10/1939 | Parkinson | 52/145 |
| 3,936,606 | A | 2/1976 | Wanke | |
| 4,064,960 | A * | 12/1977 | Murakami | 181/210 |
| 5,410,607 | A | 4/1995 | Mason et al. | |
| 5,414,775 | A | 5/1995 | Scribner et al. | |
| 5,662,136 | A | 9/1997 | Drzewiecki et al. | |
| 5,684,278 | A * | 11/1997 | Yasukawa et al. | 181/286 |
| 5,710,396 | A * | 1/1998 | Rogers | 181/208 |
| 6,173,806 | B1 * | 1/2001 | Ito | 181/210 |
| 6,260,660 | B1 * | 7/2001 | Yoerkie et al. | 181/290 |
| 6,438,242 | B1 | 8/2002 | Howarth | |
| 6,447,871 | B1 | 9/2002 | Hawkins | |
| 6,588,969 | B2 | 7/2003 | Hawkins | |
| 7,267,196 | B2 * | 9/2007 | Mathur | 181/208 |
| 2002/0046901 | A1 * | 4/2002 | Zapfe | 181/206 |
| 2002/0160173 | A1 | 10/2002 | Hawkins | |
| 2002/0172783 | A1 | 11/2002 | Hawkins et al. | |
| 2002/0176592 | A1 | 11/2002 | Howarth et al. | |
| 2003/0178250 | A1 * | 9/2003 | Putt et al. | 181/290 |
| 2005/0263346 | A1 * | 12/2005 | Nishimura | 181/290 |
| 2006/0131103 | A1 * | 6/2006 | Fuller et al. | 181/290 |

* cited by examiner

*Primary Examiner*—Jeffrey Donels
*Assistant Examiner*—Jeremy Luks
(74) *Attorney, Agent, or Firm*—Henricks, Slavin & Holmes LLP

(57) ABSTRACT

A sound suppression method includes using a passive noise suppression technology to destructively interfere with a sound wave propagating through a structure at portions of the structure that are positioned apart less than half of a wavelength of the sound wave.

25 Claims, 8 Drawing Sheets

SOUND SUPPRESSION MATERIAL AND METHOD

TECHNICAL FIELD

The invention relates generally to sound suppression and, in particular, to a sound suppression material and method that involve controlling volume changes in the material.

BACKGROUND ART

The current state of the art in noise suppression uses either passive systems or active systems. The passive systems either reflect the sound away, as with a wallboard in a house, or absorb the sound using blankets or porous materials. The active noise suppression systems use a microphone or accelerometer to detect sound and a loudspeaker to re-radiate sound that is out of phase with the original signal.

Sound propagation losses in typical passive materials follow a principle commonly referred to as the "mass law." In its most simple form, the mass law applies to air-borne sound impinging normally on a wall and states that the amount of sound transmitted into the air on the opposite side is a simple function of the mass density of the wall. This law holds because heavy materials reflect sound back towards the source more efficiently. Using this law, if sound is to be excluded from a room then the walls should be made out of very heavy material. However, this is not practical in many weight sensitive applications such as aircraft, spacecraft or automobiles.

Active noise suppression systems inject sound into the system that is 180° out of phase with the offending noise. Such systems work best when either the sound comes from a point source or the sound is cancelled at a specific point. In both cases, only one microphone and speaker, with the accompanying phase change electronics, are required. If sound comes from an extended area (such as through a wall) or it is desired to cancel the sound everywhere in a large volume, then active systems require too many electrical components to be practical.

It would be useful to be able to provide a passive material that selectively changes the phase of transmitted sound over a large area. The sound passing through this material could then be made to destructively interfere with the normally transmitted sound to cancel the sound everywhere in a large volume. Because such a material does not reduce sound by reflecting it, the mass law does not apply and a light material can be employed.

DISCLOSURE OF INVENTION

Figure 1:
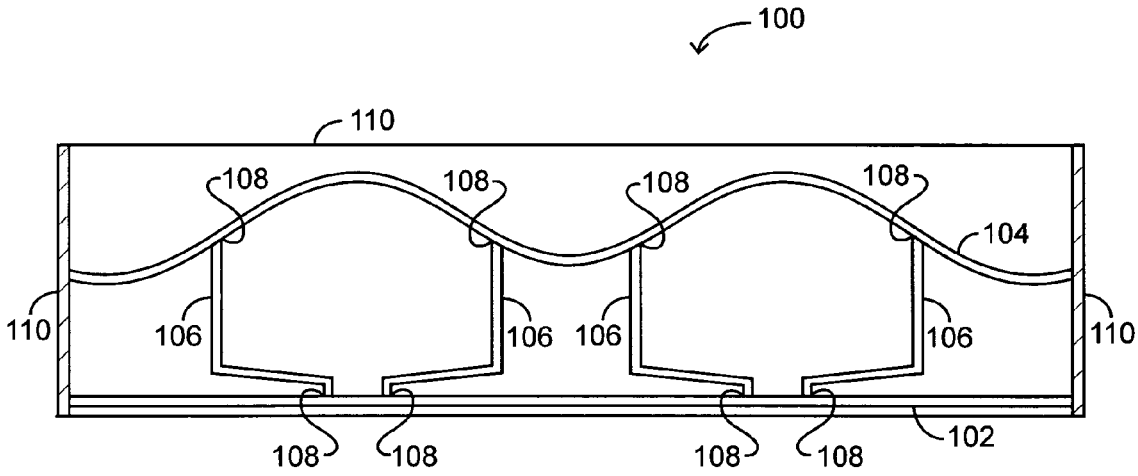
FIG. 1 is a cross-sectional view of an example embodiment of a sound suppression material.

Various embodiments of the present invention pertain to materials that suppress the radiation of sound. When a sound wave strikes one surface of such a material, portions of the opposite surface move in the direction of the sound, but other portions move in the opposite direction. The emitted wave has two components that are 180° out of phase with each other. The two waves destructively interfere with each other and the radiated sound is suppressed. Unlike many sound-dampening materials, the materials described herein do not absorb sound; rather, they work by not radiating sound.

In an example embodiment, a sound suppression material includes a base, a flexible member, and a passive mechanism mechanically coupling the base and the flexible member together such that sound pressure at the base causes portions of the flexible member to be pulled toward the base shifting a phase of sound waves passing through the portions to destructively interfere with sound waves passing through other portions of the flexible member.

Bending waves in plates or plate-like structures are quite important in most practical applications of sound isolation. This is because when the sound impinges at the proper angle, the spatial variation of the pressure field of the sound can match the wavelength of a bending wave in the plate causing an efficient excitation of the waves. This happens often in real situations because the sound impinges at all angles and the wavelength matching almost always occurs. In addition, because the motion of the bending waves is perpendicular to the surface of the plate, bending waves are good sound radiators.

In an example embodiment of the sound suppression material described herein, the phase is reversed on portions of the radiation side and the sound field is decreased by destructive interference. Consequently, this material is not a good radiator of bending waves as desired.

In various embodiments, a sound suppression material contains small (e.g., 1 mm) components that act as levers and modify the applied forces inside the material.

In various embodiments, the material is sufficiently stiff and strong to be employed as a structural component as well as a sound transmission inhibitor. In contrast, traditional sound dampening materials are not structural materials and add weight and volume to a structure.

In the process by which sound is transmitted, for example, from one room, through a wall and into an adjacent room, the sound travels from the source and impinges on one side of the wall. The sound pressure causes the wall to move slightly (i.e., most of the sound reflects off of the wall). Because the wavelengths of audible sound are large with respect to the wall thickness, the wall flexes like a membrane. The "flexing" of the wall causes a pressure wave to be radiated as sound into the adjacent room.

In an example embodiment of the sound suppression material described herein, when a sound wave strikes one surface of this material, portions of the opposite surface move in the direction of the sound, but other portions move in the opposite direction. The emitted wave has two components that are 180° out of phase with each other. The two waves destructively interfere with each other and the radiated sound is suppressed.

In Section 1, design, analysis, and experimental results of a material that causes this phase shift to occur are discussed. Section 2 includes a discussion of how sound waves destructively interfere everywhere when the sources are 180° out of phase and closer than ½ wavelength apart. Section 3 outlines an example of how this material can be manufactured.

Section 1—Construction and Performance of the Material

In an example embodiment, the sound suppression material is a honeycomb-type material that includes two face sheets and a core. When one of the facesheets moves in response to a sound wave, portions of the opposite surface vibrate 180° out of phase. Consequently, the emitted wave has two components that are 180° out of phase with each other. The two radiated waves destructively interfere with each other and the transmitted sound is suppressed.

In various embodiments, the material is based on machine augmented composite technology (see, e.g., U.S. Pat. No. 6,447,871, U.S. Pub. No. 2002/0172783 A1, and U.S. Pub. No. 2002/0160173 A1, all of which are incorporated herein by reference). In various embodiments, the machines constitute the core of a honeycomb material.

In various embodiments, the honeycomb is configured for mounting in a stiff frame such that the applied loads over the surface of the honeycomb are coupled to the frame. Referring to FIG. 1, in an example embodiment, a sound suppression material 100 includes a first facesheet 102, a second facesheet 104, and L-brackets 106 in the core. By way of example, the first facesheet 102 is made from a typical structural material such as aluminum, and is bonded to the lower edges of the L-brackets 106. In an example embodiment, a low modulus (flexible) adhesive 108 is used at these bonds, which allows the L-brackets 106 to rotate with respect to the first facesheet 102. The top edges of the L-brackets 106 are bonded to second facesheet 104, which can also be made from aluminum or other structural materials. In this example embodiment, the second facesheet 104 has a regular curved structure that repeats every other bracket.

In the illustrated example embodiment, this structure is mounted in a frame 110 with the L-brackets 106 and both skins (the first and second facesheets 102 and 104) firmly bonded to the frame. In this example embodiment, the sound suppression material 100 is secured to the frame 110 at the edges, i.e., at the boundaries, of the facesheets 102 and 104 and at the ends of the L-brackets 106. In an example embodiment, the L-brackets 106 are made of a stiff material and are only connected (mechanically coupled) to each other through the first and second facesheets 102 and 104 by the flexible adhesive 108. This allows the L-brackets 106 to deform somewhat independently as discussed below.

Figure 2:
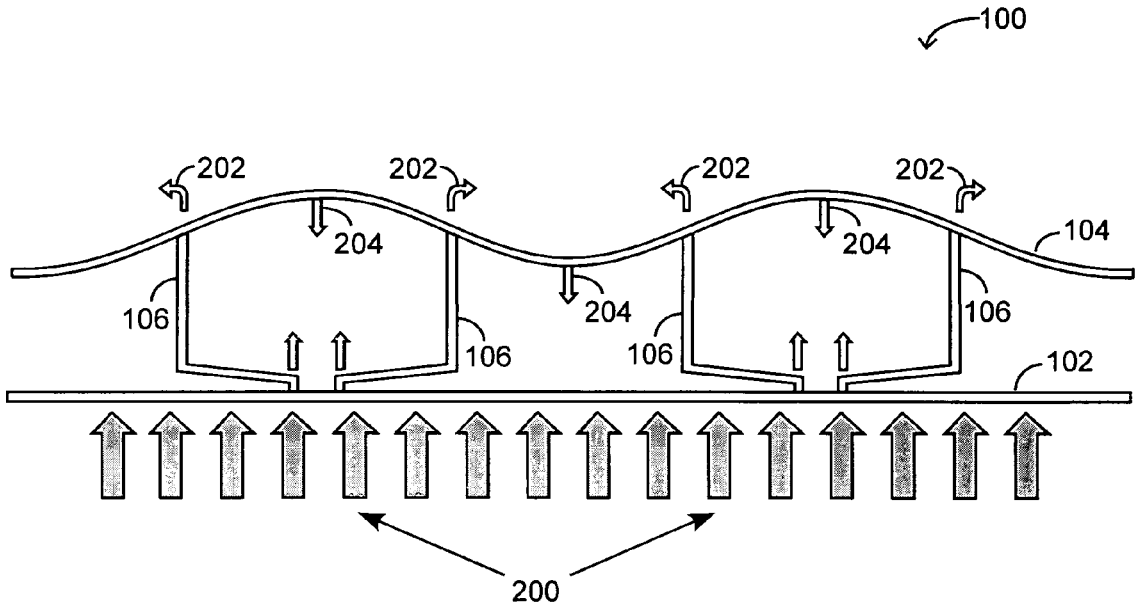
FIG. 2 shows how the sound suppression material of FIG. 1 responds to a uniform force incident upon its lower facesheet.

FIG. 2 illustrates how the sound suppression material 100 responds to a uniform force (indicated by arrows 200) incident upon the first facesheet 102. For clarity, the frame 110 is not shown in this figure. In this example, when a pressure wave impinges on the first facesheet 102, the load is transmitted through the lower skin (the first facesheet 102) to the lower edge of the L-bracket 106. Because the ends of the L-brackets 106 are bonded in a frame as described herein, each L-bracket 106 responds to this load by rotating around its shear center which is located near the ~90° angle in the L-bracket 106. This movement causes the upper edge of the L-bracket 106 to deform upward and laterally as indicated by arrows 202. In this example embodiment, the L-brackets 106 are paired are shown with mirror images of each other. Consequently, the upper edges of adjacent L-brackets 106 move laterally in opposite directions to each other. This causes the second facesheet 104, in the area between the brackets, to change its radius of curvature to accommodate the change in distance between the brackets. This results in the second facesheet 104 flattening out and moving downward as indicated by the arrows 204. Thus, in this example, when a pressure wave pushes up on the lower facesheet 102 of this material, a portion of the upper facesheet 104 moves up and a portion of it moves down.

In an example embodiment, the sound suppression material 100 is configured such that an equal volume of material moves up as moves down (i.e., when averaged over the surface, the material does not move).

Virtually every common material responds to an increasing strain with an increasing resistive force. However, in some special cases, such as a buckled tube or a material near a magnetic phase transition, the force decreases as the strain increases. This effect has been referred to as a negative modulus. Portions of the materials described herein move in a direction opposite to the applied force. It should be noted however that the materials described herein are not negative modulus materials. Careful inspection of the load path shows that the materials described herein are properly responding to the combination of levers that have reversed the direction of the force.

Finite Element Analysis of the Material

A computer model of an example sound suppression material was constructed using advanced finite element analysis software from ABAQUS, Inc. The individual material properties were taken from book values. Because of the symmetry in this design, the model only needed to calculate the response of one of the unit cells in the material, i.e., only one-fourth of the structure needs to be calculated. In this model, the material is fixed in the back plane and a force has been applied at the front corner. The lower skin was left out of the model because it merely transmits forces to the brackets.

Figure 3:
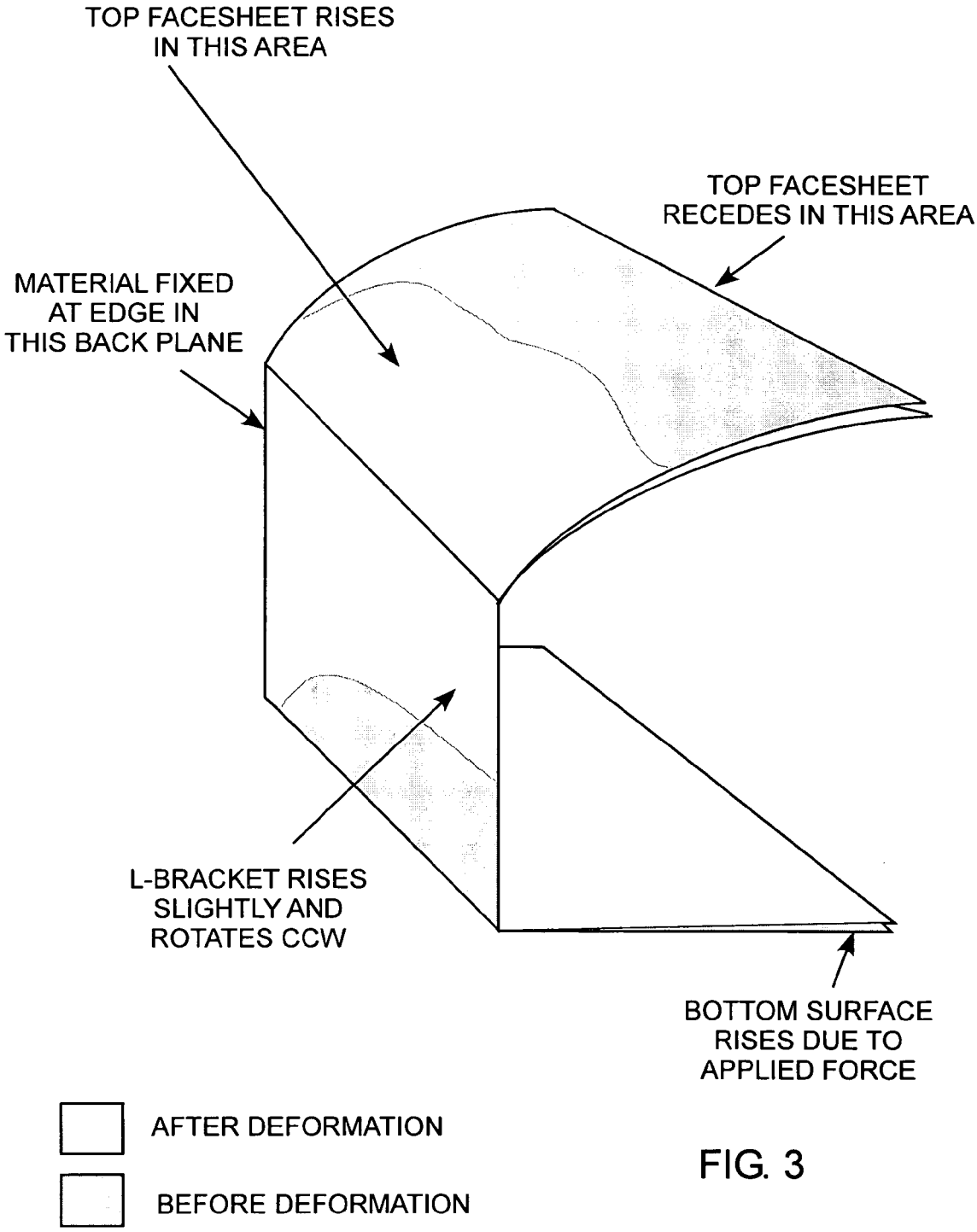
FIG. 3 shows the results of a Finite Element Analysis of an example sound suppression material.

FIG. 3 shows the results of the Finite Element Analysis of this material. More specifically, FIG. 3 shows the result of the ABAQUS calculations and displays the response of the material to a force exerted on the lower edge of the L-bracket. The undeformed state is displayed as textured and the deformed state without a texture. The lower skin (not shown in this figure) transmits the load to the lower edge of the L-brackets. As shown, the L-brackets rotate and move up slightly in response to a force on this edge. Due to the rotation, the upper edge of the L-bracket moves up slightly and to the left. The L-bracket pulls on the upper skin causing it to flatten such that the middle moves down. In this case, the top facesheet moves down about the same distance that the bottom surface moves up.

Experiment and Results

An experiment was performed to demonstrate movement of one part of a sound suppression structure in a direction opposite to a force applied to the structure. Two L-brackets manufactured out of aluminum were used. The L-brackets were 18 inches long, and had 1 inch wide by ⅛-inch thick legs. The L-brackets were connected at the bottom with aluminum metal tape so they could rotate (at the joint between them) but not translate with respect to each other. A strip of 0.004" thick aluminum that was bowed up slightly was connected to the tops of the L-brackets. Aluminum metal tape bonded the top strip to the L-brackets.

The sample was fixed to a base plate at each end and mounted above a shaker. The shaker was positioned equidistant from the ends of the sample and configured to impart force up and down at a chosen frequency on the centerline at the interface of the two brackets. An accelerometer was placed on the bottom of the sample, on the centerline where the shaker touches the sample, and another accelerometer was placed on the top strip, directly above the lower accelerometer.

Figure 4:
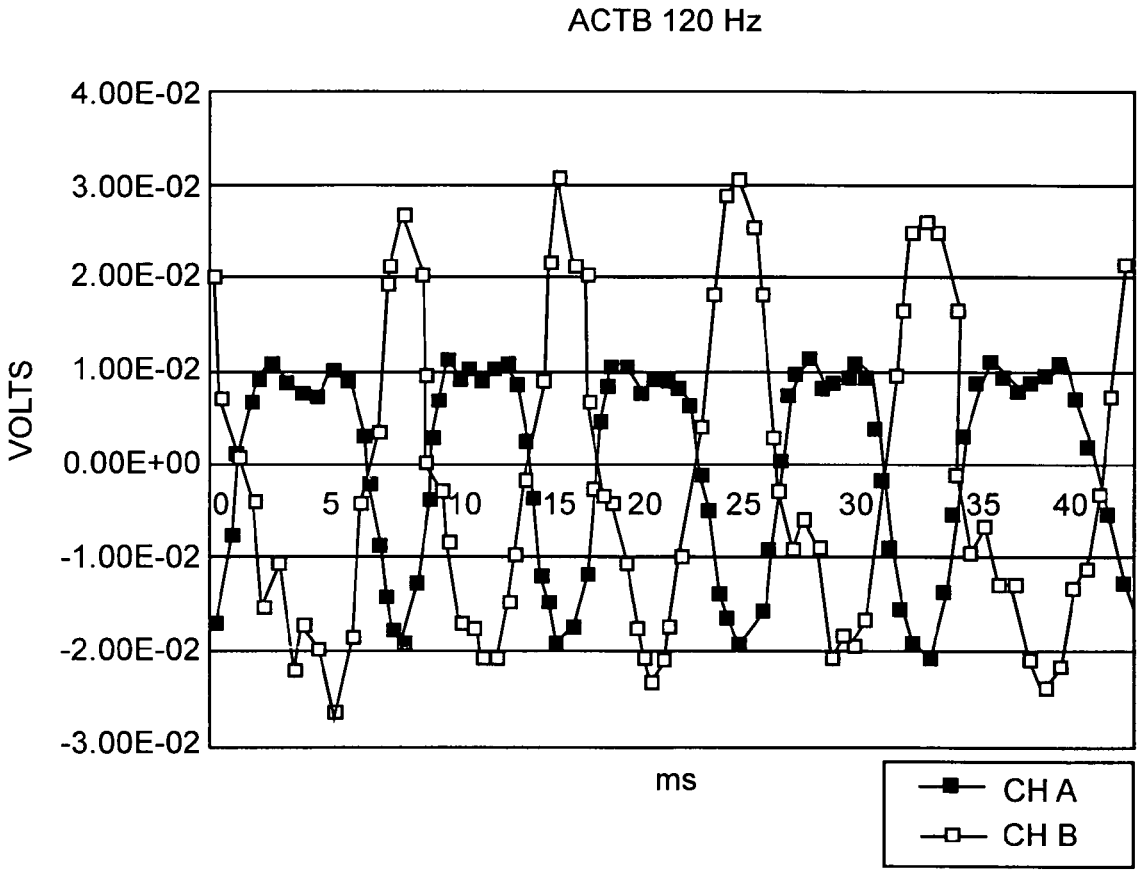
FIG. 4 shows the output voltages of two accelerometers mounted to an experimental sound suppression structure during vibration of the structure.

In the experiment, the shaker was vibrated at 120 Hertz and output voltages of the accelerometers were measured. FIG. 4 shows the output voltages of the two accelerometers. Channel A is from the top accelerometer. Channel B is from the bottom accelerometer. As can be seen from the graph, when the shaker pushed repeatedly on the bottom, the top moved at the same frequency but 180° out of phase. This shows that the two faces were vibrating with a 180° phase difference.

Section 2—Interference of Sound Waves from Closely Spaced Sources

Figure 5:
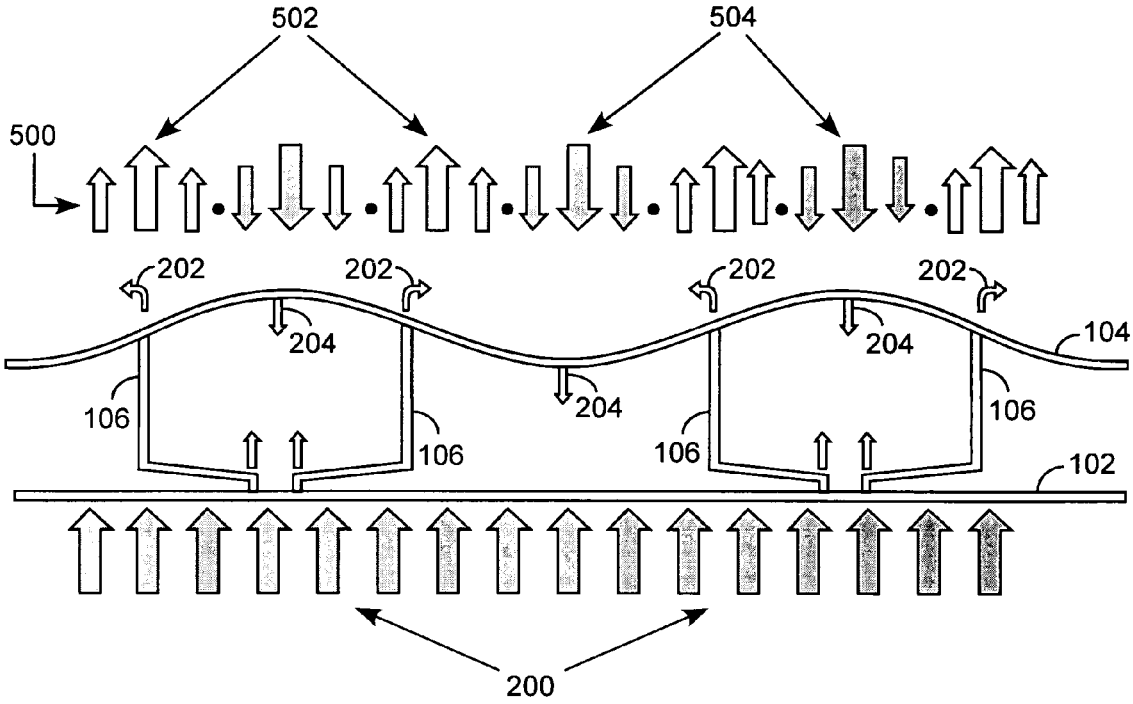
FIG. 5 shows how a sound wave incident upon the bottom of the sound suppression material of FIG. 1 is transmitted as a sound wave with two components, each out of phase by 180°.

FIG. 5 shows how the materials described herein convert a sound wave 200 all in a single phase to a wave 500 with two components that are 180° out of phase with each other. For clarity, the frame 110 is not shown in this figure. In this figure, the in phase components 502 and out of phase components 504 (of the transmitted sound wave 500) are shown over the arrows 202 and 204, respectively.

Figure 6:
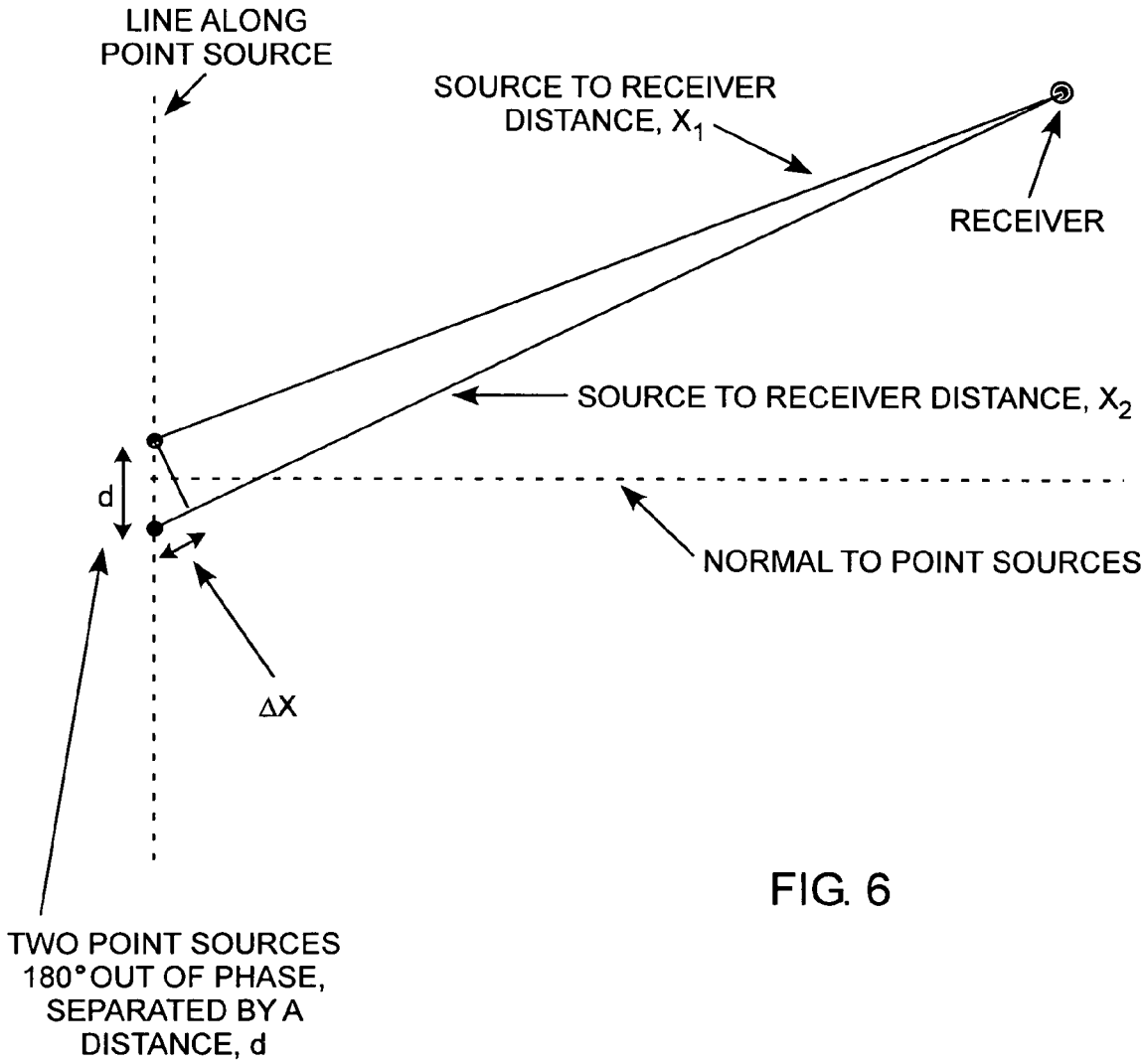
FIG. 6 shows two point sources 180° out of phase, separated by a distance, d.

The resulting sound wave can be analyzed as emanating from a series of sources radiating sound 180° out of phase with their neighbors. To simplify the math, in FIG. 6, two sound waves emanating from two point sources separated by a distance d are considered. A receiver some distance away detects these waves with amplitude $X_1$ and $X_2$ where, $$X_1 = A_o \sin \omega t$$

and $$X_2 = A_o \sin(\omega t + \pi + \delta)$$

where the two waves have frequency ω, amplitude $A_o$, and wavelength λ. The phase difference between the waves includes π, because they are 180° out of phase, and the phase difference due to the path length difference (δ). This phase difference due to the path can be written as $$\delta = 2\pi \frac{\Delta X}{\lambda} \tag{1}$$

The amplitude of the combined waves can be calculated using a trigonometric identity to yield, $$X_{sum} = 2A_o \sin(\delta/2)\cos(\omega t + \delta/2) \tag{2}$$

The resultant wave is seen to have the same frequency as the original wave with its amplitude and phase modified by the phase difference between the two waves. The amplitude is a maximum (constructive interference) when δ=π. Using equation 1, it can be seen that the first maximum occurs when $$\Delta X = \lambda/2.$$

Consequently, if ΔX is less than λ/2 then no constructive interference occurs anywhere. This is the case when the sources are less than λ/2 apart. In fact, equation 2 shows that the amplitude goes to zero as the phase difference due to the path length (δ) goes to zero.

Figure 7:
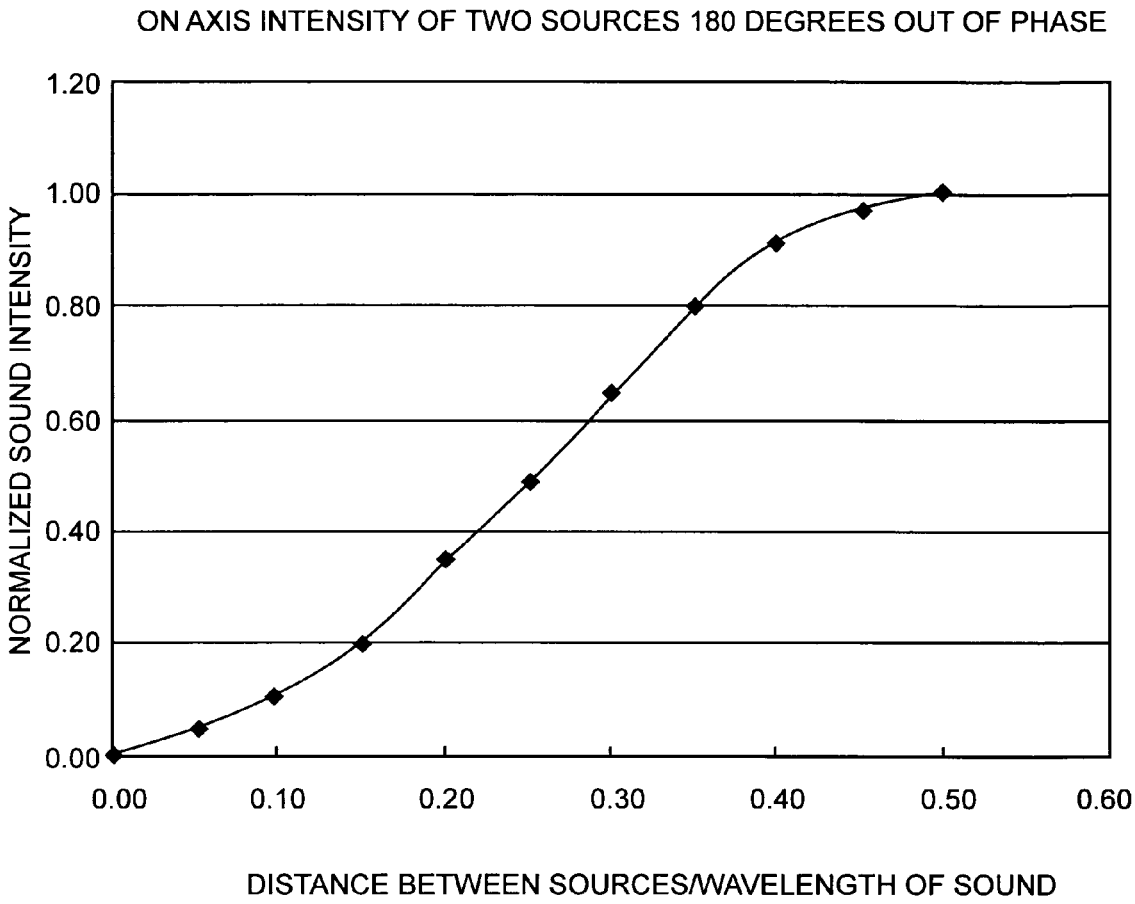
FIG. 7 is a plot of on axis intensity (normalized sound intensity) of two sources 180 degrees out of phase versus distance between sources/wavelength of sound.

FIG. 7 shows the sound intensity (the square of the sound's amplitude) as a function the distance between the sources when the receiver is on a line with the sources. The maximum path difference between the sources occurs on this line. The distance between the sources has been normalized relative to a wavelength of sound resulting in a unitless number, d/λ. In addition, the amplitude has been normalized so the maximum amplitude is equal to unity. It should be observed how this maximum occurs when d=λ/2 and two sources are in phase. For smaller values, the waves destructively interfere and the maximum intensity decreases to zero as the sources get closer.

It should be appreciated that this plot applies when the receiver is on-axis with the sources and represents the maximum sound intensity of any location of the receiver. Because the sound sources are closer than a wavelength, if the receiver were at any other off-axis location, the phase difference would be smaller than on-axis and the amplitude would be less than this. In addition, the amplitude decreases to identically zero when the receiver is normal to the axis.

The preceding argument shows that when sound sources are 180° out of phase and are closer than half a wavelength apart, the resulting sound wave destructively interferes everywhere in space. The maximum sound intensity can be made arbitrarily small by decreasing the distance between the sound sources. Although total destructive interference may seem unphysical, it does not violate conservation of energy. The two sources interact as the pressure wave from one cancels the refraction caused by the other.

In an example embodiment, a sound suppression material includes a base, a flexible member, and multiple phase shifters positioned between the base and the flexible member, the phase shifters being configured to pull portions of the flexible member toward the base in response to sound pressure at the base, adjacent phase shifters being positioned apart less than half of a wavelength of a sound wave impinging upon the base to prevent constructive interference with the sound wave propagating through other portions of the flexible member.

In an example embodiment, a sound suppression method includes using a passive noise suppression technology to destructively interfere with a sound wave propagating through a structure at portions of the structure that are positioned apart less than half of a wavelength of the sound wave.

In an example embodiment, portions of a "front face" of a sound suppression material are pushed and pulled in equal amounts such that no volume change occurs, i.e., such that the material, on average, does not move. Because sound is stimulated by a volume change that compresses air, this results in suppression of sound.

In an example embodiment, a sound suppression method includes repositioning portions of a surface of a material in response to a sound wave incident upon the material such that the surface, on average, does not move.

In an example embodiment, a sound suppression method includes controlling a flexible surface of a material in response to a sound wave incident upon the material such that movements of the flexible surface result in substantially no change in a volume of the material.

Section 3—Manufacturing the Material

For this material to cancel sounds throughout the audio range, the brackets must be spaced less than one half wavelength apart. In air, the velocity of sound is, $$V_{air} = 356 \text{ m/sec.}$$

The audio range extends close to 20,000 Hz where a wavelength is, $$\lambda(20{,}000 \text{ Hz}) = 1.8 \text{ cm}$$

and a half a wavelength is $$\lambda(20{,}000 \text{ Hz})/2 = 9 \text{ mm}$$

Consequently, if the material is made with struts ~1 mm apart it would cancel sound throughout the entire audio range.

Alternate Design

Figure 8:
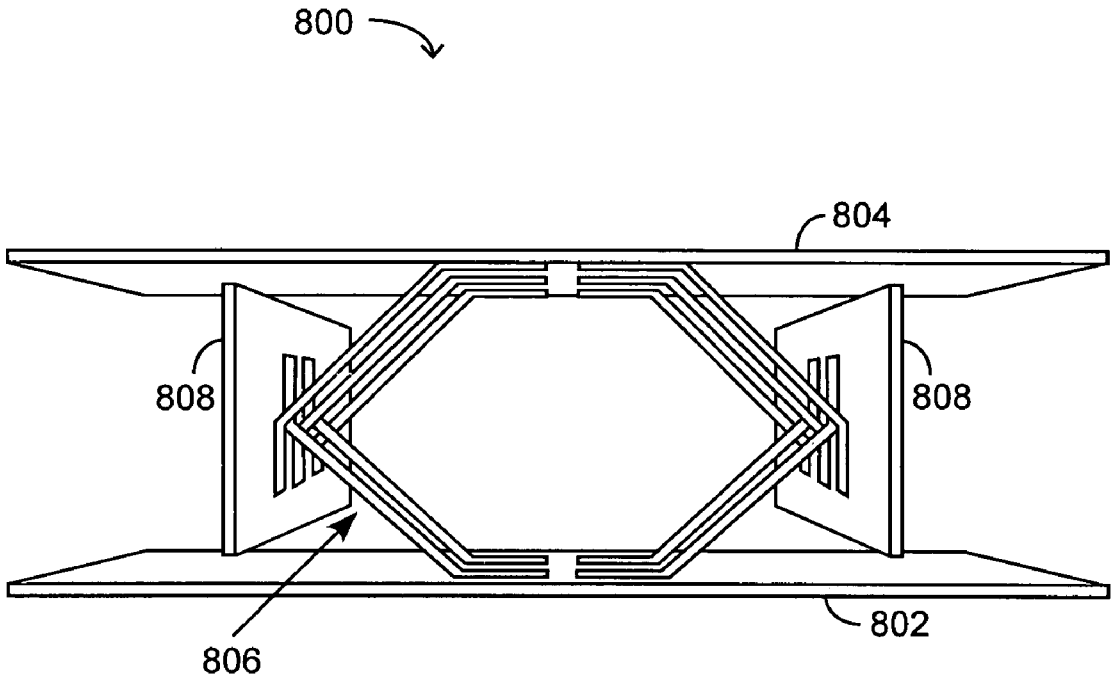
FIG. 8 shows another example embodiment of a sound suppression material.

FIG. 8 shows another example embodiment of a sound suppression material 800. In this example embodiment, the sound suppression material 800 includes a first face sheet 802, a second face sheet 804, and a series of angled struts 806 that connect (mechanically couple) beams 808 to the face sheets as shown. The beams are much thinner than they are tall so they resist bending vertically but easily bend outward.

When a sound wave impinges on the bottom face sheet 802 from below, the face sheet 802 pushes up and forces the angled struts 806 to push up and out. The beams 808 do not allow much upward motion so they mostly move out. The outward motion of the beams 808 forces the upper set of struts 806 to pull down on the upper face sheet 804. As a result, the upper face sheet 804 moves down as the lower face sheet 802 moves up. This gives the desired result of changing the phase of the emitted sound wave by 180°.

True multifunctional materials that both carry load and suppress sound radiation have been described herein. In an example embodiment, a multifunctional material includes a structural component including a passive core mechanism configured to manipulate a surface of the multifunctional material in response to a sound wave incident upon the multifunctional material such that transmission of the sound wave through the multifunctional material is inhibited. In an example embodiment, a multifunctional material includes a facesheet mechanically coupled to multiple structural members which impart forces upon the facesheet in response to a sound wave impinging upon the multifunctional material such that components of the sound wave propagating through portions of the facesheet destructively interfere with other components of the sound wave propagating through the multifunctional material.

Depending on the application, the materials can be made, for example, out of steel, aluminum, composites, or plastics. By properly establishing geometry and stiffness relationships among the materials components, a great variety of different materials structures that function to suppress sound can be provided. There are many applications where materials employing the principles described herein can be used as both a structure and a sound barrier. Such applications include, but are not limited to, automobile firewalls, aircraft fuselages, machinery enclosures, jet engine nacelles, and launch vehicle shrouds.

Although the present invention has been described in terms of the example embodiments above, numerous modifications and/or additions to the above-described embodiments would be readily apparent to one skilled in the art. It is intended that the scope of the present invention extends to all such modifications and/or additions.

What is claimed is:

1. A sound suppression material comprising:

a base;

a flexible member; and a passive mechanism mechanically coupling the base and the flexible member together such that sound pressure at the base causes portions of the flexible member to be pulled toward the base shifting a phase of sound waves passing through the portions to destructively interfere with sound waves passing through other portions of the flexible member;

wherein the passive mechanism is not provided with a support structure about which the passive mechanism is configured to rotate;

wherein the passive mechanism is configured to respond to the sound pressure by rotating about its shear center.

2. A sound suppression material comprising:

a base;

a flexible member; and a passive mechanism mechanically coupling the base and the flexible member together such that sound pressure at the base causes portions of the flexible member to be pulled toward the base shifting a phase of sound waves passing through the portions to destructively interfere with sound waves passing through other portions of the flexible member;

wherein the passive mechanism is not provided with a support structure about which the passive mechanism is configured to rotate;

wherein the passive mechanism is configured to respond to the sound pressure by deforming longitudinally and laterally in relation to the flexible member.

3. A sound suppression material comprising:

a base;

a flexible member; and a passive mechanism mechanically coupling the base and the flexible member together such that sound pressure at the base causes portions of the flexible member to be pulled toward the base shifting a phase of sound waves passing through the portions to destructively interfere with sound waves passing through other portions of the flexible member;

wherein the passive mechanism is not provided with a support structure about which the passive mechanism is configured to rotate;

wherein the passive mechanism includes brackets arranged in a pattern.

4. The sound suppression material of claim 3, wherein the flexible member has a regular curved structure that repeats every other bracket.

5. The sound suppression material of claim 3, wherein the passive mechanism is configured to respond to the sound pressure by imparting forces that change a radius of curvature of areas of the flexible member between the brackets.

6. The sound suppression material of claim 3, wherein the brackets are arranged as mirrored pairs.

7. The sound suppression material of claim 3, wherein the brackets are L-shaped.

8. A sound suppression material comprising:

a base;

a flexible member; and a passive mechanism mechanically coupling the base and the flexible member together such that sound pressure at the base causes portions of the flexible member to be pulled toward the base shifting a phase of sound waves passing through the portions to destructively interfere with sound waves passing through other portions of the flexible member;

wherein the passive mechanism is not provided with a support structure about which the passive mechanism is configured to rotate;

wherein the passive mechanism includes a series of angled struts.

9. A sound suppression material comprising:

a base;

a flexible member; and multiple phase shifters positioned between the base and the flexible member, the phase shifters being configured to pull portions of the flexible member toward the base in response to sound pressure at the base, adjacent phase shifters being positioned apart less than half of a wavelength of a sound wave impinging upon the base to prevent constructive interference with the sound wave propagating through other portions of the flexible member;

wherein the multiple phase shifters are not provided with support structures about which the multiple phase shifters are configured to rotate.

10. The sound suppression material of claim 9, wherein the base, flexible member and multiple phase shifters together provide a honeycomb-type structure, with the multiple phase shifters serving as a core of the honeycomb-type structure.

11. The sound suppression material of claim 9, wherein the multiple phase shifters include lever mechanisms configured to respond to the sound pressure by rotating.

12. The sound suppression material of claim 9, wherein the multiple phase shifters include lever mechanisms configured to respond to the sound pressure by deforming longitudinally and laterally in relation to the flexible member.

13. The sound suppression material of claim 9, wherein the multiple phase shifters include brackets arranged in a pattern.

14. The sound suppression material of claim 13, wherein the flexible member has a regular curved structure that repeats every other bracket.

15. The sound suppression material of claim 13, wherein the multiple phase shifters are configured to respond to the sound pressure by imparting forces that change a radius of curvature of areas of the flexible member between the brackets.

16. The sound suppression material of claim 13, wherein the brackets are arranged as mirrored pairs.

17. The sound suppression material of claim 13, wherein the brackets are L-shaped.

18. The sound suppression material of claim 9, wherein the multiple phase shifters include a series of angled struts.

19. A multifunctional material comprising:

a facesheet mechanically coupled to multiple structural members, which impart forces upon the facesheet in response to a sound wave impinging upon the multifunctional material such that components of the sound wave propagating through portions of the facesheet destructively interfere with other components of the sound wave propagating through the multifunctional material;

wherein the multiple structural members are not provided with support structures about which the multiple structural members are configured to rotate;

wherein the structural members are configured to apply forces inside the multifunctional material.

20. The multifunctional material of claim 19, wherein the facesheet is made of a flexible material.

21. The multifunctional material of claim 19, wherein the facesheet is made of aluminum.

22. A multifunctional material comprising:

a facesheet mechanically coupled to multiple structural members, which impart forces upon the facesheet in response to a sound wave impinging upon the multifunctional material such that components of the sound wave propagating through portions of the facesheet destructively interfere with other components of the sound wave propagating through the multifunctional material;

wherein the multiple structural members are not provided with support structures about which the multiple structural members are configured to rotate;

wherein the structural members are configured to act as levers.

23. A multifunctional material comprising:

a facesheet mechanically coupled to multiple structural members, which impart forces upon the facesheet in response to a sound wave impinging upon the multifunctional material such that components of the sound wave propagating through portions of the facesheet destructively interfere with other components of the sound wave propagating through the multifunctional material;

wherein the multiple structural members are not provided with support structures about which the multiple structural members are configured to rotate;

wherein the structural members include L-brackets.

24. A multifunctional material comprising:

a facesheet mechanically coupled to multiple structural members, which impart forces upon the facesheet in response to a sound wave impinging upon the multifunctional material such that components of the sound wave propagating through portions of the facesheet destructively interfere with other components of the sound wave propagating through the multifunctional material;

wherein the multiple structural members are not provided with support structures about which the multiple structural members are configured to rotate;

wherein the structural members include angled struts.

25. A multifunctional material comprising:

a facesheet mechanically coupled to multiple structural members, which impart forces upon the facesheet in response to a sound wave impinging upon the multifunctional material such that components of the sound wave propagating through portions of the facesheet destructively interfere with other components of the sound wave propagating through the multifunctional material;

wherein the multiple structural members are not provided with support structures about which the multiple structural members are configured to rotate;

wherein the structural members are approximately 1 mm in size.

* * * * *